US005440081A

United States Patent [19]

Thompson

[11] Patent Number: 5,440,081

[45] Date of Patent: Aug. 8, 1995

[54] SYSTEM AND METHOD OF PROTECTING OPTICAL ELEMENTS FROM DOWN-HOLE FLUIDS

[75] Inventor: Jack T. Thompson, Port Hueneme, Calif.

[73] Assignee: Westech Geophysical, Inc., Ventura, Calif.

[21] Appl. No.: 343,205

[22] Filed: Nov. 22, 1994

Related U.S. Application Data

[63] Continuation of Ser. No. 263,482, Jun. 21, 1994, abandoned, which is a continuation of Ser. No. 62,691, May 21, 1993, abandoned.

[51] Int. Cl.[6] ..... G01V 1/40

[52] U.S. Cl. ..... 181/102; 348/85

[58] Field of Search ..... 181/102, 104; 358/100; 346/33 WL; 340/853.1; 166/250

[56] References Cited

U.S. PATENT DOCUMENTS

| | | | |
|---|---|---|---|
| 4,171,578 | 10/1979 | Meador | 33/314 |
| 4,532,545 | 7/1985 | Hanson | 358/100 |
| 5,123,492 | 6/1992 | Lizanec, Jr. | 166/250 |
| 5,140,319 | 8/1992 | Riordan | 340/854.9 |

*Primary Examiner*—Ian J. Lobo

*Attorney, Agent, or Firm*—Fulwider Patton Lee & Utecht

[57] ABSTRACT

A surfactant composition is used to repel down-hole fluids such as crude oil and water to prevent remote viewing cameras from being obscured by such fluids, for extended periods of time. An effective amount of a down-hole fluid repelling surfactant, preferably in the form of a liquid solution, is applied to an exterior surface of an optical element of the viewing instrument, dried, and polished to prevent down-hole fluids from adhering to the surface of the optical element. A preferred liquid surfactant solution contains as an active ingredient an amount of tricresyl phosphate effective to repel down-hole fluids such as oil and water.

23 Claims, 3 Drawing Sheets

FIG. 1
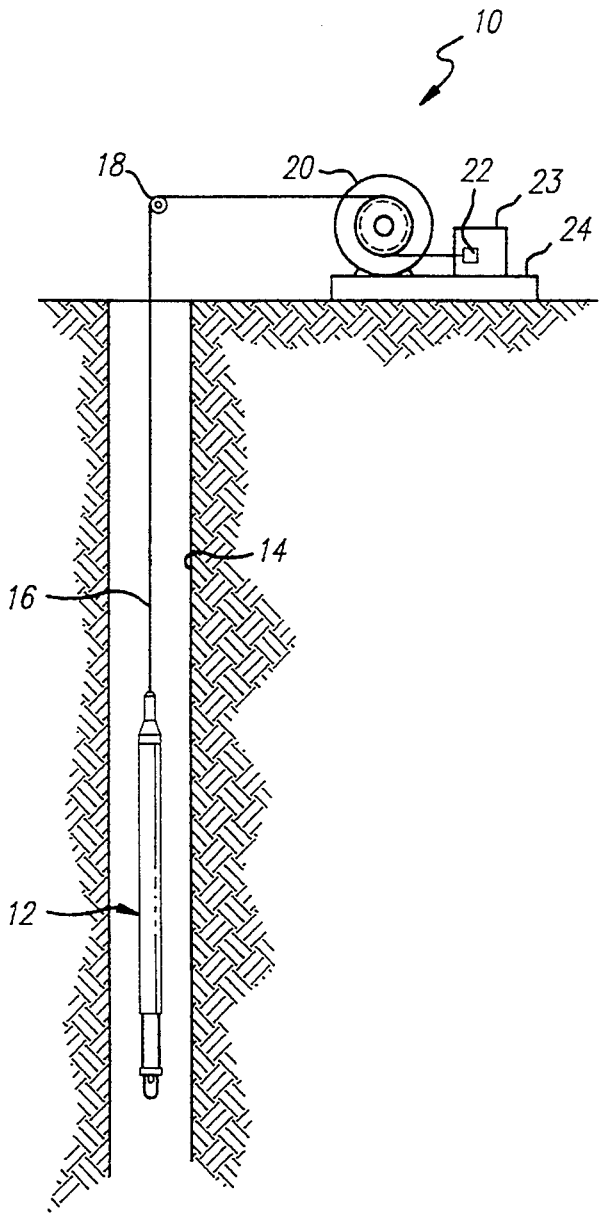
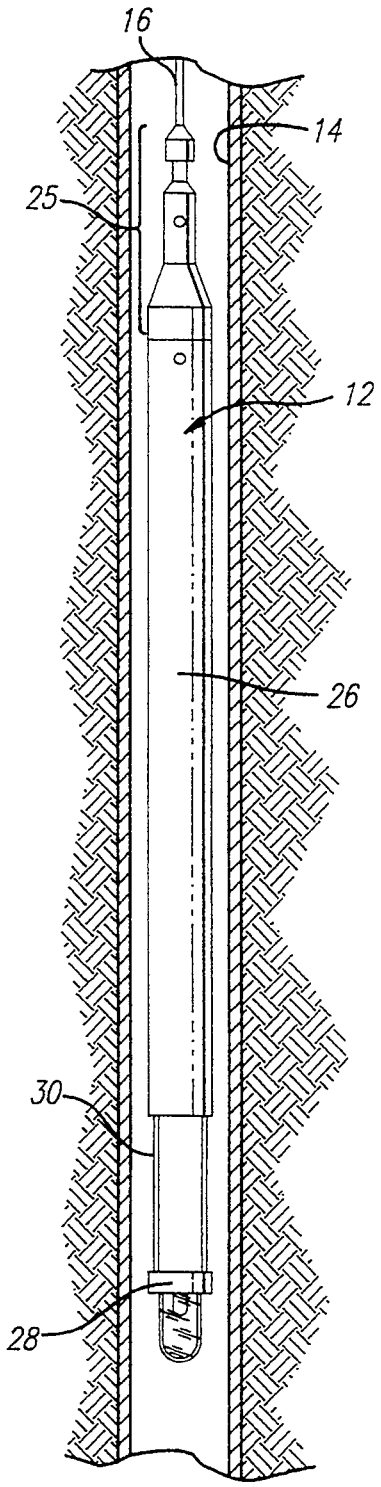
FIG. 2

SYSTEM AND METHOD OF PROTECTING OPTICAL ELEMENTS FROM DOWN-HOLE FLUIDS

This application is a continuation, of application Ser. No. 08/263,482 filed Jun. 21, 1994, now abandoned, which is a continuation of application Ser. No. 08/062,691 filed on May 21, 1993 now abandoned.

BACKGROUND OF THE INVENTION

1. Field of the Invention

This invention relates generally to viewing down-hole conditions in a well, and more particularly concerns use of a surfactant to prevent a down-hole viewing instrument from being obscured by down-hole fluids such as oil and water.

2. Description of Related Art

Remote video camera systems incorporated in down-hole instrument probes can be particularly useful for visually examining wells. One of the more common uses is leak detection. The camera system may detect turbulence created by a leak and may identify different fluids leaking into the well bore. Particulate matter flowing out through a hole can be detected. Damaged, parted, or collapsed tubings and casings may also be detected. The severity of scale buildup in downhole tubulars, flow control devices, perforations and locking recesses in landing nipples can be seen and analyzed.

Additional uses for video camera systems include the detection of formation fractures and their orientations. Video logging provides visual images of the size and extent of such fractures. Downhole video is also useful in identifying downhole fish and can shorten the fishing job. Plugged perforations can be detected as well as the flow through those perforations while the well is flowing or while liquids or gases are injected through the perforations. Corrosion surveys can be performed with downhole video and real-time viewing with video images can identify causes for loss of production, such as sand bridges, fluid invasion or malfunctioning down-hole flow controls.

In all the above uses for down-hole video, it is important for the optical elements of such video camera systems, including windows, lens systems and lighting systems, to remain clear. A substantial amount of time can be involved in lowering the instrument into the well, raising the instrument up out of the well to clean the viewing or lighting elements of adherent fluids such as oil residing in the well which obscure the camera's view or attenuates the light output from the lighting system, and then lowering the instrument again. A video camera system that becomes fogged or obscured by crude oil will provide no useful data, and can delay operations. The presence of down-hole fluid, which can include oil, water, and gases, is common in such wells, and the video camera system is more efficient if the viewing and lighting elements of the video camera system are unobscured by such fluids for extended periods of time. As used herein, the term "optical element" is meant to not only apply to the elements through which images pass to reach the camera, but also to the clear or light transmissive domes or other components over light generating devices. The term "video camera system" is meant to include not only the video camera, lens, and any other optical elements for image development such as a port window, but also the lighting equipment used to illuminate down-hole subject matter.

One particularly troublesome situation involves strata of fluids in a well. Where images of the well below a stratum of crude oil are desired, it may be effectively impossible to place a clear instrument in position. Each time the instrument passes the oil layer, the exposed optical and lighting elements may become obscured by oil adhering to the optical elements. Removing the instrument to clean it will have little effect, because the instrument must pass through the same stratum after reinsertion.

Detergents, phosphates, petroleum-based coatings, acidified ethanol/isopropanol polish, and wetting agents have been used to inhibit condensation on the lens of a real-time down-hole video instrument. Various anti-fogging compositions effective for inhibiting condensation of moisture on a surface are known, including hydroaromatic alcohols, amphoteric surface active agents, silicone, linear fatty alcohol ether sulfates, hydrocarbon waxes and hydrophilic resin coatings, which have been used for inhibiting condensation of moisture on visors, windshields, and the like. However, it has been found that these coatings do not remain on the optical elements of a down-hole instrument in a sufficient amount long enough to be effective to prevent the optical elements from being obscured by oil and other well fluids under the severe environment of high temperature, pressure, and caustic fluids that can exist in a well. The harsh conditions within a well can involve hydrostatic well pressures in excess of $4.2\times10^6$ kilograms per square meter (6,000 pounds per square inch) and ambient wall temperatures of 110° C. (230° F.) and higher. Some wells contain hydrogen sulfide gas which can have a deleterious effect on an instrument probe. It would be desirable to provide a system for producing images of down-hole conditions over an extended period of time and not have that system rendered inoperative due to the adherence of obscuring down-hole fluids or the action of caustic fluids. Coating the optical elements of a down-hole video instrument with a surfactant that would repel crude oil, inhibit condensation of moisture, and keep the optical elements of such a down-hole video system unobscured by such fluids is desirable.

However, another factor to be considered in protecting the optical elements of a down-hole viewing instrument that are exposed to down-hole fluids is the possibility that a compound applied to the surface of an optical element as a surfactant could mar, etch and essentially destroy the surface of the optical element or degrade sealing material around such an optical element under the high pressure, high temperature conditions found at great depths in well bores. Degrading the sealing material can have a disastrous effect in that the high pressure fluids may enter the instrument and render electrical circuits inoperative and cause other damage. It would be desirable that application of such a surfactant compound should not only protect the optical element to which it is applied from down-hole fluids, but also not be injurious to the surface or seal of the optical element at high temperatures and pressures. The invention meets these needs.

SUMMARY OF THE INVENTION

Briefly, and in general terms, the present invention provides for a novel use of a surfactant composition to repel down-hole fluids such as oil and water to prevent remote viewing camera systems from being obscured by such fluids, for extended periods of time.

The invention is accordingly directed to a method of preventing down-hole fluids of a well from obscuring a down-hole viewing instrument exposed to such down-hole fluids. In the method, an effective amount of a down-hole fluid repelling surfactant is applied to an exterior surface of an optical element of the viewing instrument to prevent down-hole fluids from adhering to the surface of the optical element. In one aspect of the method, the down-hole fluid repelling surfactant is applied in the form of a liquid surfactant solution, which is applied to the exterior surface of the optical element and dried to provide a layer of dry surfactant on the exterior surface of the optical element. The layer of dry surfactant on the exterior surface of the optical element typically can also be polished. The surfactant composition can also be advantageously applied to the protective window of a lighting device used for illuminating the portion of the well being examined.

A preferred liquid surfactant solution contains as an active ingredient an amount of tricresyl phosphate effective to repel down-hole fluids such as oil and water when applied to optical elements of a down-hole viewing instrument. One preferred surfactant solution consists essentially of three basic ingredients: tricresyl phosphate, ethanol, and water. The liquid surfactant mixture applied typically includes from about 9% to about 25% tricresyl phosphate, about 7% to about 12.5% ethanol, with the remainder being water, from about 84% to about 62.5%, by weight. In a currently preferred embodiment, the liquid surfactant mixture consists essentially of approximately 25% tricresyl phosphate, 12.5% ethanol, and 62.5% water, by weight.

The surfactant composition can be used on lenses, protective windows, and the like, of down-hole video instruments used in the high pressure, high temperature environment of oil wells and other types of wells.

These and other aspects and advantages of the invention will become apparent from the following detailed description, and the accompanying drawings, which illustrate by way of example the features of the invention.

BRIEF DESCRIPTION OF THE DRAWINGS

FIG. 1 is an overall block diagram of a well logging system with which the lens preparation surfactant composition of the invention is used in the method of the invention;

FIG. 2 is a side view of an instrument probe in place in a well showing the camera section and light section with which the method of the invention is used;

DETAILED DESCRIPTION OF A PREFERRED EMBODIMENT

Figure 3:
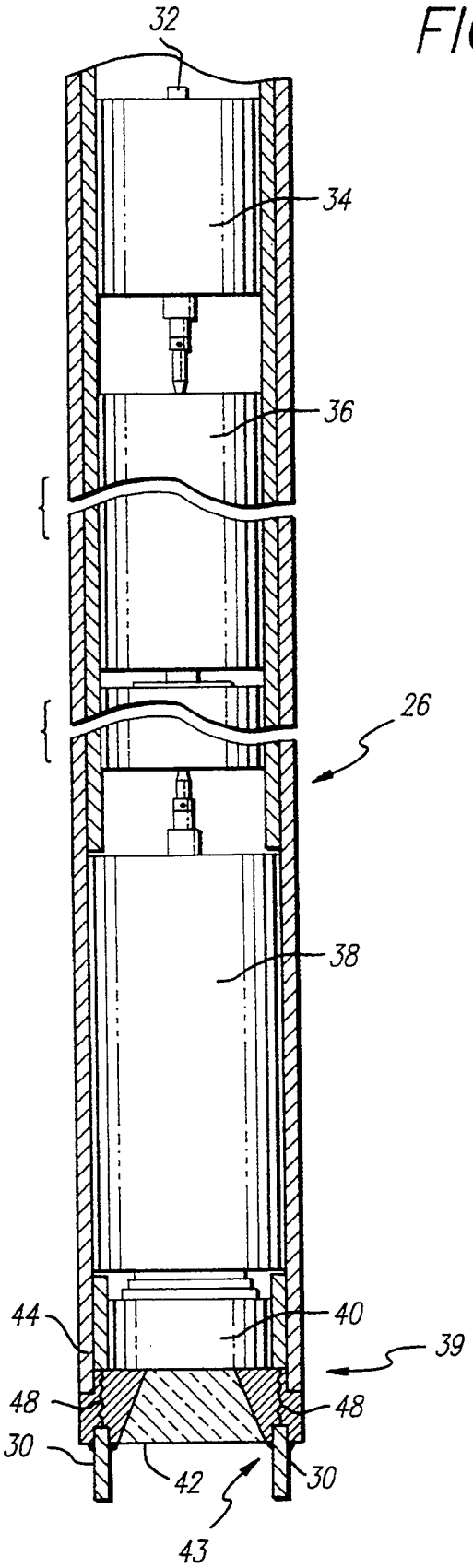
FIG. 3 is a partial cross-sectional side view of part of the camera section of the probe showing the camera, lens and window cover, and mount for the light section with which the method of the invention is used.

There is frequently a need to examine the casings and fittings of wells visually for corrosion and other adverse conditions, and to examine the contents of a well to be able to distinguish the existence of water, crude petroleum, and natural gas. One well-logging system for examining wells is described in U.S. Pat. No. 5,202,944, which is incorporated herein by reference. Such wells can often be a mile or more deep, and can subject a viewing instrument to high temperatures and pressures. Clearing a fouled lens system and lighting system of such a viewing instrument can delay operations a substantial amount of time. The invention concerns a method and a system of preventing down-hole fluids of a well from obscuring a down-hole viewing instrument exposed to such down-hole fluids by applying a surfactant coating to the optical elements of the viewing instrument that are exposed to such down-hole fluids.

As is illustrated in the drawings, the invention is intended for use in a well logging system 10, shown in FIG. 1 for examining the interior of a well. The well logging system includes a well instrument probe 12 to be lowered into a well 14. The instrument probe is suspended from a support cable 16 retained in a sheave 18, and a rotatable winch 20 for hoisting and lowering the support cable and probe. A surface controller 22 is provided in an enclosure 23 on a transportable platform 24, which is typically a skid unit, for controlling the operation of the winch. The surface controller also receives and processes information provided by the probe, and the enclosure may also contain a recorder, such as a video tape recorder, for recording the information provided by the probe.

The instrument probe, shown in greater detail in FIG. 2, includes three sections: a cable head 25 connected to the support cable, a camera head 26, and a light head 28. The light head is attached to the camera head by three legs 30, two of which are shown. The camera head is illustrated in greater detail in FIG. 3. The distal end section 32 of the support cable is coupled to an optical transmitter or converter 34, where electrical signals representing images from the camera are converted into optical signals, and are typically transmitted through an optical fiber (not shown) in the support cable to the surface. Such electrical/optical converters and couplers for coupling the converter to the optical fiber are well known in the art.

Figure 5:
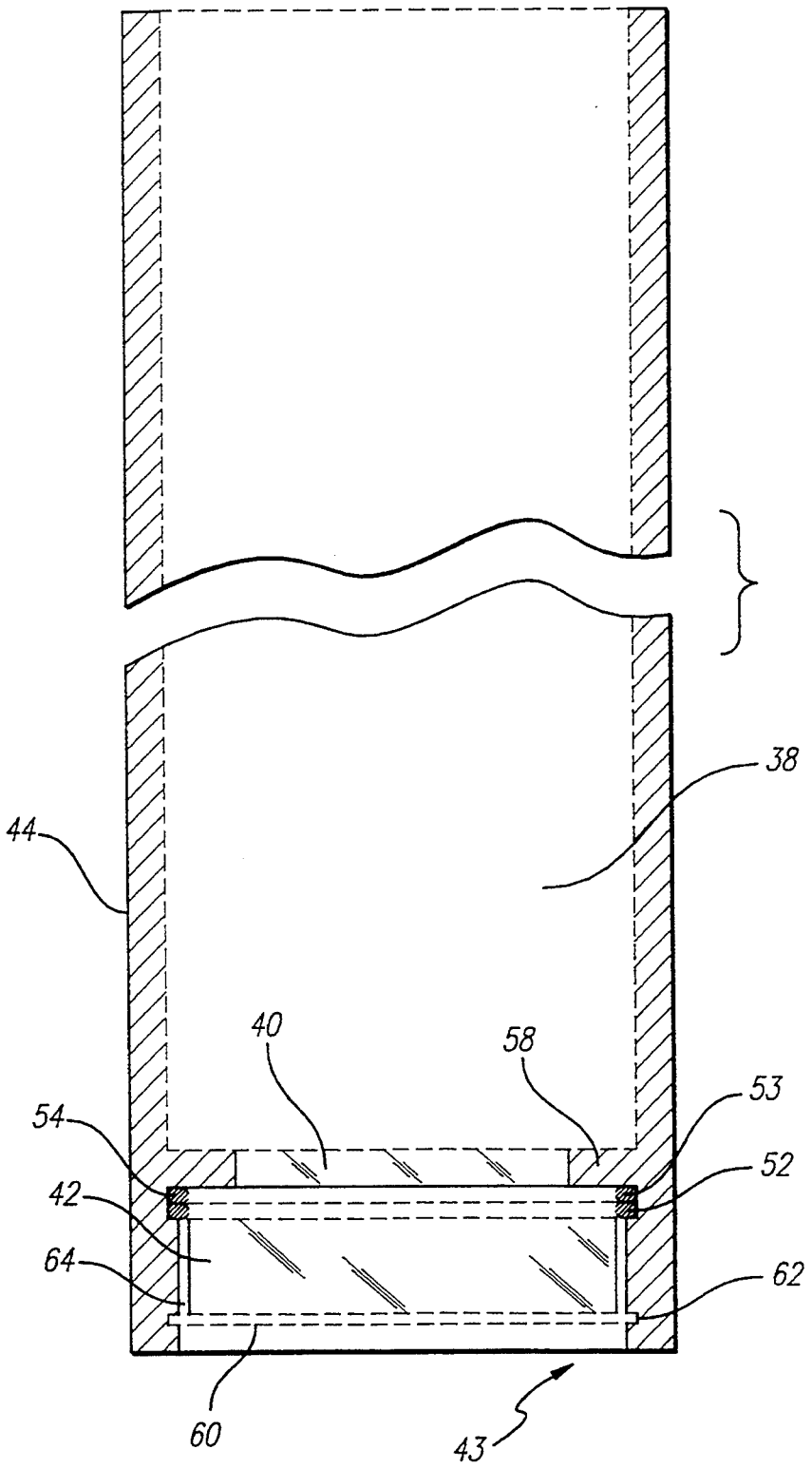
FIG. 5 is a cross-sectional view of a camera lens, port window and fluid seal of the system for protecting optical elements from down-hole fluids in accordance with the invention.

The electrical power carried by the cable is converted in the electrical section 36 into the voltages required by the camera 38 and other electrical equipment. In a currently preferred embodiment, the camera is a charge coupled device (CCD) type television camera that is capable of providing high speed, high resolution images in relatively dim light. One suitable camera is the CCD Video Camera Module, model number XC 37 made by Sony Corporation. In this embodiment, the lens system 39 of the camera includes two major optical elements, namely a lens 40, which can for example be a fisheye lens preferably made of tempered borosilicate glass, such as that sold under the tradename "PYREX" and available from Corning Glass Works, and an outer protective port window 42 optical element, which is preferably made of heat treated Pyrex glass, and can be formed in a frustoconical shape as shown in FIG. 3, or in a cylindrical shape as is illustrated in FIG. 5 as will be further explained hereinafter. The lens and its protective window are preferably heat tempered to improve the strength and durability of the lens system. The protective window is located in the opening 43 of the housing 44, and seals and protects the camera head at the bottom end of the camera against high temperature and high pressure fluids that can exist in a well.

Figure 4:
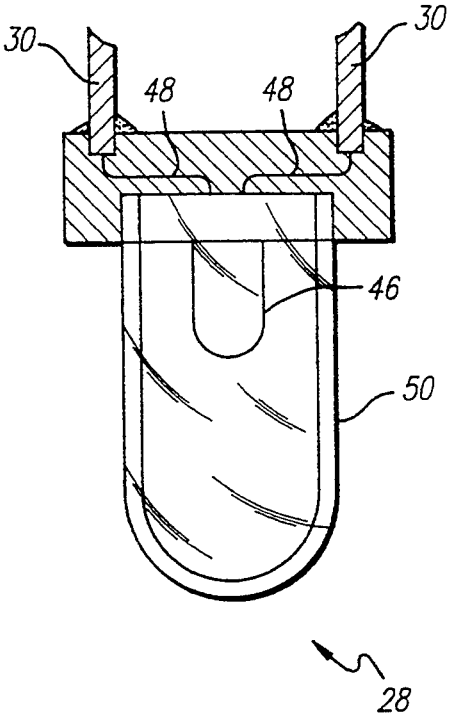
FIG. 4 is a partial cross-sectional view of the light section of the instrument probe with which the method of the invention is used.

With reference to FIG. 4, the light head preferably includes a powerful lamp, such as halogen lamp 46, and electrical conductors 48 routed through the support legs of the light head mounted to the camera head. The light head also preferably includes a protective lighting window 50 optical element for sealing and protecting the lamp from the high temperatures and pressures in the well. The lighting window 50 is clear to allow the passage of light without significant attenuation.

It has been found that proper application of a suitable surfactant to the port window 42 and the lighting dome of the camera can repel oil and inhibit condensation that can otherwise severely obstruct the video picture from the camera. Application of such a surfactant to the lens system has permitted viewing of wells with high oil concentrations for more than eight hours without oil adhering to the camera lens system. Even after traversing thousands of feet through a column of oil in a well, with a proper application of the surfactant to the lens system, visual clarity was immediately experienced when a clear medium was encountered in the well.

In the method, an effective amount of the surfactant is applied to the exterior surface of the lens system of the camera to prevent down-hole fluids such as crude oil and water from adhering to the surface of the lens system. The surfactant is preferably applied to the exterior surface of the protective window, to prevent oil and condensation from obscuring the window. A successful surfactant for repelling a fluid needs to be at least somewhat soluble in the fluid, but should be sufficiently insoluble to have an effective working life under the expected working conditions. The compound selected for repelling down-hole fluids such as oil and water should have a balance between the surface active properties as a wetting agent reducing the interfacial tension between the fluid and the solid surface on which it is used, and the insolubility of the compound. A compound that is too soluble can be too rapidly removed by the fluid to be repelled to be effective for a useful period. Another factor to be considered in the selection of the surfactant compound to be used for protecting the optical elements of a down-hole viewing instrument is the possibility that the compound could harm the optical elements or seals for the lens system under the high pressure, high temperature conditions found at great depths in well bores. Some surfactants can etch and essentially destroy the tempered materials of the optical elements under the high pressures and temperatures existing within a well, or can degrade the qualities of the fluid seals.

One preferred surfactant capable of repelling down-hole fluids, such as oil and water from obscuring the optical elements of a down-hole camera system, and that has found not to be injurious to the surface of the optical elements and fluid seals at high down-hole temperatures and pressures is tricresyl phosphate (TCP). In a preferred embodiment, the surfactant is applied in the form of a liquid surfactant solution to the exterior surface of the optical element to be protected, and dried to provide a protective layer of dry surfactant on the exterior surface of the optical element. The layer of dry surfactant on the exterior surface of the optical element is also preferably polished on the surface of the optical element for clear viewing. The surfactant composition can similarly be applied to the protective window and the lamp of the light head to prevent down-hole fluids from obstructing the illumination provided by the light head. Although tricresyl phosphate is described herein as an exemplary surfactant compound, other surfactant compounds with similar properties may also be suitable for use in the method of the invention.

The basic requirements of the liquid surfactant solution to be used according to the method of the invention are the appropriate surfactant compound selected, and a solvent vehicle for the surfactant compound that can be evaporated to dryness to leave a dry film of the surfactant compound in place on the optical element to be protected. One preferred liquid surfactant solution to be applied according to the method and system of the invention consists essentially of three basic ingredients: tricresyl phosphate, ethanol, and water. Tricresyl phosphate is miscible with common solvents and thinners, and oils such as vegetable oils, but is relatively insoluble in water. The ethanol aids solution of tricresyl phosphate in water to form the liquid surfactant mixture for application to the surface to be protected. The liquid surfactant mixture applied typically is formulated to include from about 9% to about 25% tricresyl phosphate, about 7% to about 12.5% ethanol, the remainder of the liquid mixture being water, from about 84% to about 62.5%, by weight. In a currently preferred embodiment, the liquid surfactant mixture consists essentially of approximately 25% tricresyl phosphate, 12.5% ethanol, and 62.5% water, by weight.

The surfactant composition can be used on optical elements such as lenses, protective viewing windows, as well as reflective optical elements, light sources, light source domes and the like, that can be utilized in down-hole viewing instruments used in the high pressure, high temperature environment of oil wells and other types of wells. Although a solvent vehicle of ethanol and water has been described for use in the preferred liquid surfactant solution in the method of the invention, it should be recognized that other evaporative solvent delivery systems that are compatible with the surfactant compound selected and the optical elements to which the surfactant solution is to be applied may also be suitable. It is also possible that an appropriate solvent delivery system might not need to be evaporative in order to properly apply the surfactant composition.

Referring now to FIGS. 3, 4 and 5, the surfactant may be applied to the exterior surface of the port window 42 and the dome 50 over the light source 46. In this case a halogen light source is shown but in other applications, other light sources such as light emitting diodes may be used. Other light sources will also typically have an optical element covering the actual illumination device and the surfactant may be applied to that optical element.

FIG. 5 shows one assembly of a camera, lens, port window and fluid seal. The port window 42 optical element in one embodiment was tempered borosilicate glass and the fluid seal about the port window was a rubber nitrile compound 52 having a wide temperature range of operation, such as about −54° C. to 135° C. (−65° F. to 275° F.), disposed in a groove 54 in the camera housing 56. One such fluid seal is the Parker nitrile O-ring composition 756 available from Parker's Seal Group in Lexington, Ky. A backup fluid seal ring 53 is also preferably provided along with the Parker nitrile O-ring composition, such as the "PARBAK" ring available from Parker's Seal Group. Where even higher temperatures are expected, a silicone seal may be used such as the Parker silicone O-ring or the General Electric silicone O-ring. The port window 42 optical element shown in FIG. 5 can have a cylindrical shape, in which case the camera housing preferably includes a reduced diameter portion 58 which acts as a stop surface for the port window 42. In FIG. 5, the port window 42 optical element is pressed into the port 59 to properly compress the seal and is held in position by the snap ring 60, which in one embodiment is formed of stainless steel, such as the snap ring sold under the trade name "SPIROLOX" PR115S, available from Kaydon Ring and Seal, Inc., of St. Louis, Mo., and which is disposed in a snap ring groove 62 in the housing. A lubricant 64 such as Parker's "Super O-Ring Lubricant" is typically applied around the outside edge of the port window before pressing it into the port.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A method of preventing down-hole well fluid including oil from obscuring a down-hole viewing instrument having an optical element exposed to such down-hole well fluid, comprising the step of:

applying a down-hole well fluid repelling surfactant to an exterior surface of an optical element of the viewing instrument, said surfactant containing tricresyl phosphate as an active ingredient to prevent said down-hole well fluid from adhering to the surface of said optical element.

2. The method of claim 1, wherein said down-hole well fluid repelling surfactant is applied in the form of a surfactant solution, and said surfactant solution consists essentially of about 9% to about 25% tricresyl phosphate, about 7% to about 12.5% ethanol, and about 84% to about 62.5% water, by weight.

3. The method of claim 2, wherein said surfactant solution consists essentially of approximately 25% tricresyl phosphate, 12.5% ethanol, and 62.5% water, by weight.

4. The method of claim 1, wherein said down-hole well fluid repelling surfactant is applied in the form of a surfactant solution, and the step of applying the down-hole well fluid repelling surfactant comprises:

applying the surfactant solution to a surface of the optical element, and drying the surfactant solution on the surface of the optical element to provide a layer of dry surfactant on the surface of the optical element.

5. The method of claim 4, further including the step of polishing the layer of dry surfactant on the surface of the optical element.

6. The method of claim 1, wherein said down-hole viewing instrument includes lighting means for illuminating a portion of the well to be viewed with the down-hole viewing instrument, and said step of applying said down-hole well fluid repelling surfactant to said surface of said optical element comprises applying said down-hole well fluid repelling surfactant to a surface of an optical element of said lighting means to prevent said down-hole well fluid from adhering to the surface of said optical element of said lighting means.

7. The method of claim 6, wherein said down-hole well fluid repelling surfactant is applied in the form of a surfactant solution, and the step of applying the down-hole well fluid repelling surfactant comprises:

applying the surfactant solution to the surface of the optical element, and drying the surfactant solution on the surface of the optical element to provide a layer of dry surfactant on the surface of the optical element of said lighting means.

8. A method for providing electrical signals which are representative of images of down-hole conditions in a well having fluids which tend to adhere to optical elements and obscure their view of the images, the method comprising the steps of:

mounting a camera in a housing, the housing having an opening facing the camera through which images may pass;

mounting an optical element in the opening, the optical element formed of a material which permits the images to pass with relatively little attenuation;

sealing the optical element to the housing, the seal being formed of a material which resists the passage of the well fluids; and applying a down-hole well fluid repelling surfactant to an exterior surface of the optical element, said surfactant containing tricresyl phosphate as an active ingredient to prevent said down-hole well fluid from adhering to the exterior surface of said optical element.

9. The method of claim 8, wherein the down-hole well fluid repelling surfactant is applied as a surfactant solution to the exterior surface of the optical element, and further comprising the steps of drying the surfactant solution to leave a dry film of tricresyl phosphate on the exterior surface of the optical element, and polishing the dry film of tricresyl phosphate on the exterior surface of the optical element.

10. The method of claim 9, wherein said surfactant solution consists essentially of about 9% to about 25% tricresyl phosphate, about 7% to about 12.5% ethanol, and about 84% to about 62.5% water, by weight.

11. The method of claim 9, wherein the surfactant solution consists essentially of approximately 25% tricresyl phosphate, 12.5% ethanol, and 62.5% water, by weight.

12. The method of claim 8, wherein said camera further includes a lighting device having a protective window, and further comprising the step of applying said down-hole well fluid repelling surfactant to an exterior surface of the protective window of the lighting device to prevent said down-hole well fluid from adhering to the exterior surface of the protective window of the lighting device.

13. The method of claim 8, further comprising the step of forming the optical element of borosilicate glass.

14. A method for protecting an optical element of a down-hole viewing instrument used for examining the interior of a well, the optical element having an exterior surface exposed in the well to down-hole fluid including oil, comprising the steps of:

applying a surfactant solution to an exterior surface of the optical element, said surfactant solution containing tricresyl phosphate as an active ingredient to prevent said down-hole fluid from adhering to the exterior surface of said optical element, and a solvent vehicle for the tricresyl phosphate;

drying the surfactant solution to evaporate said solvent vehicle to leave a dry film of tricresyl phosphate on the exterior surface of said optical element; and polishing said dry film of tricresyl phosphate on the exterior surface of said optical element.

15. The method of claim 14, wherein said surfactant solution consists essentially of about 9% to about 25% tricresyl phosphate, about 7% to about 12.5% ethanol, and about 84% to about 62.5% water, by weight.

16. The method of claim 14, wherein the surfactant solution consists essentially of approximately 25% tricresyl phosphate, 12.5% ethanol, and 62.5% water, by weight.

17. The method of claim 14, wherein said down-hole viewing instrument includes a lighting device having a protective window, and further comprising the step of applying said surfactant solution to an exterior surface of the protective window of the lighting device, drying said surfactant solution to leave a dry surfactant film on the exterior surface of the protective window, and polishing the dry surfactant film on the exterior surface of the protective window to prevent said down-hole fluid from adhering to the exterior surface of the protective window of the lighting device.

18. A system for transmitting images of conditions in a well hole from a camera located in a down-hole instrument in the well hole and for extending the amount of time that such images can be transmitted from the camera, the system comprising:

an optical element having an outer surface exposed to the conditions down-hole and through which the images must pass to reach the camera; and a coating applied to the outer surface of the optical element, the coating containing tricresyl phosphate as an active ingredient effective to repel well fluid including oil from the outer surface of the optical element.

19. The system of claim 18, wherein the optical element comprises a window used to seal the camera from substances existing down-hole.

20. The system of claim 18, wherein the optical element comprises a lens which focuses images for the camera.

21. The system of claim 18, wherein the coating is applied to the outer surface of said optical element as a surfactant solution consisting essentially of about 9% to about 25% tricresyl phosphate, about 7% to about 12.5% ethanol, and about 84% to about 62.5% water, by weight.

22. The system of claim 18, wherein the coating is applied to the outer surface of said optical element as a surfactant solution consisting essentially of approximately 25% tricresyl phosphate, 12.5% ethanol, and 62.5% water, by weight.

23. A down-hole instrument comprising:

a camera for receiving images of conditions in a well hole;

an optical element having an outer surface exposed to the conditions down-hole and through which the images must pass to reach the camera; and a coating applied to the outer surface of the optical element, the coating containing tricresyl phosphate as an active ingredient effective to repel well fluid including oil from the outer surface of the optical element.

* * * * *